United States Patent [19]

Scales

[11] Patent Number: 4,911,426

[45] Date of Patent: Mar. 27, 1990

[54] INTERCHANGEABLE SUPPORT AND HARNESS EXERCISER SYSTEM

[76] Inventor: Mary E. Scales, P.O. Box 4036 Stn. A., Victoria, B.C., Canada, V8X 3X4

[21] Appl. No.: 143,519

[22] Filed: Jan. 7, 1988

Related U.S. Application Data

[63] Continuation-in-part of Ser. No. 928,252, Nov. 7, 1986, abandoned.

[30] Foreign Application Priority Data

May 22, 1986 [CA] Canada ..... 509697

[51] Int. Cl.[4] ..... A63B 1/00; A63B 3/00; A63B 7/00

[52] U.S. Cl. ..... 272/70; 128/845; 297/275; 297/278; D6/333

[58] Field of Search ..... D6/333, 334; 297/275, 297/274, 277, 280, 467, 485, 4, 15, 278, 471; 272/70, 70.3, 70.4, 109, 144, 85, 90, 91; 2/70, 211, 221, 237, DIG. 6; 119/96, 101; 128/133-135, 845, 846, 869, 870, 875; 244/151 R

[56] References Cited

U.S. PATENT DOCUMENTS

| | | | |
|---|---|---|---|
| 178,680 | 6/1876 | Shaw | 297/275 |
| D. 268,232 | 3/1983 | Scales | D6/333 |
| 1,379,082 | 5/1921 | Cavanaugh | 297/280 X |
| 1,435,756 | 11/1922 | Sweeney | 2/70 X |
| 2,443,085 | 6/1948 | Sachs | 2/221 |
| 2,657,688 | 11/1953 | Tucker | 128/134 |
| 2,775,288 | 12/1956 | Anastasia | 297/485 |
| 2,792,052 | 5/1957 | Jonhannesen | 272/70.4 |
| 2,852,066 | 9/1958 | Hawkins | 297/275 X |
| 3,252,704 | 5/1966 | Wilson | 272/70.3 |
| 3,721,436 | 3/1973 | Barthel, Jr. | 272/70 |
| 3,778,052 | 12/1973 | Andow et al. | 272/70.3 |
| 4,497,069 | 2/1985 | Braunhut | 2/DIG. 6 X |
| 4,628,622 | 12/1986 | McBarron | 2/DIG. 6 X |

*Primary Examiner*—Richard J. Apley
*Assistant Examiner*—David J. Bender

[57] ABSTRACT

This invention discloses, a therapeutic exerciser system, suspended from a horizontal trapezoid frame, with a movable balance point, connected by a cleated fiddle block pulley assembly, to an eye bolt installed in an overhead beam, or to the rolling traveler on an overhead track, and providing specially developed support sections. The disclosed therapeutic exerciser system, has a common upper body support section combined with, any one of three, inter-changeable, different types, of lower body supports; a bucket seat, a crotch piece, or a pelvic support. The range of motion available to the user is determined by their own ability and by the type of support that the bucket seat, crotch piece or pelvic support provides. This invention can also be used, by a treatment provider, to facilitate vestibular stimulation and sensory integration techniques and other treatment modalities, for users who may be unable to move themselves. The harness of the exerciser system being suspended from a trapezoid frame, with an adjustable pivot point of balance, allowing body positions from semi-reclined to upright.

3 Claims, 9 Drawing Sheets

INTERCHANGEABLE SUPPORT AND HARNESS EXERCISER SYSTEM

Cross Reference to Related Applications;

This is a continuation-in-part of application U.S. Ser. No. 06/928,252, now abandoned.

BACKGROUND OF THE INVENTION

1. Field of the Invention

This invention relates to the therapeutic needs of multiply handicapped children and adults and is intended to be used in treatment programs directed by physicians, who are experts in this specialized field, with therapists, nurses, teachers, or parents, providing the treatment.

2. Description of the Prior Art

This invention is an improvement over U.S. Des. No. 268,232, March 15, 1983, by this inventor, Scales. Scales's previous design is for general public use by the "normal" baby weighing up to forty pounds and does not meet the needs of larger disabled children or adults.

Scales's above mentioned invention has a shock cord spring and chain assembly found to be too difficult for a therapist, teacher or parent to position a user over forty pounds weight at the correct distance from the floor. This invention uses a pair of self-locking fiddle block pulleys strung with shock cord to provide easy lifting, resilience and height adjustability.

In Scales, the upper body support's under-arm sections have extra snaps on the right side and size adjustment seams on the left side, to be opened, as the baby grows. But, Scales has no quick way to make the upper body support smaller around the waist again, on the left side. The upper body support of this invention is equipped with zippers and VELCRO hook and loop tape closures, to provide three bi-lateral waist size adjustments, on each of the six basic size models, which can be quickly changed to larger, smaller, larger, as per the needs of each disabled child or adult in a peer group.

Scales has a fixed balance point where the four suspension lines, of fixed length, converge above the circular hoop. This invention has a horizontal trapezoid frame, with a movable balance point connection and a choice of two placements to attach the rear suspension straps to the horizontal trapezoid frame. In this invention, the length of each of the four suspension straps can be adjusted, as needed. Moving the balance point connection to the front of the horizontal trapezoid frame, lengthening the rear suspension strap a few inches, and moving the rear suspension straps to the alternative back suspension strap placements on the horizontal trapezoid frame, tilts the user into a semi-reclined position with full head and spine support.

The lower body, or crotch section, in Scales, is of fixed length and designed to cradle the "normal" baby's buttocks and support his/her weight, with the hips slightly flexed and the knees slightly bent, for bouncing, swinging and turning. This invention has a similar crotch section but the outline is shaped, by curves and darts, to conform to body contours, as well as, providing for length adjustment, by way of two center front straps, with side release buckles, such as FASTEX, and one horizontal zipper sewn on to the fabric, on the outside rear surface, of the improved crotch section. When the horizontal zipper is closed a horizontal internal pleat in the fabric is formed. Opening the zipper releases the horizontal internal pleat extending the length at the back of the improved crotch section. The male FASTEX side-release buckle connections on the two center front straps, provide front length adjustment, as required. These new features allow treatment providers to lengthen or shorten the improved crotch section until the upper body support comes up the user's torso, high enough for safety, and low enough for underarm comfort. The fabric area between the user's legs has a removable foam rubber pad for comfort.

This invention has two additional alternative, interchangeable, lower body supports, not provided by Scales. The first, a bucket seat lower body support, was found to be required for persons who are not able to weight-bear and must have their hips supported in a flexed position. The bucket seat, in this invention, has a wrap-around fabric section at the back extending nearly to the front, and a seat portion, with a concealed, removable, padded board, providing a limited range of position, at the user's hips. Adjusting the four straps on the outer rear surface of the wrap-around fabric section, and adjusting the length at each end of the front strap that connects the bucket seat to the front of the upper body support, allows the care giver to change the overall depth of the bucket seat, the tilt from side-to-side and the angle of flexion at the users hip joints. An adjustable seat belt is positioned to maintain the user's buttocks towards the rear of the seat portion. The second, a pelvic support, was needed when the user gained balance, co-ordination, and muscle strength, and was ready to kneel or stand up straight and begin gait-training. The pelvic support, of this invention, has an internal wrap-around section, with an adjustable strap, which, when closed between the navel and pubic areas, provides lift from under the abdominal bulge. The pelvic support's outer, front and back, fabric panels have six external straps; two leg straps, at the tops of the legs sewn to the back fabric panel, with male FASTEX side-release buckle connections that mate up with female FASTEX side-release buckle components attached to the front fabric panel at an angle designed to maintain the back fabric panel under the user's buttocks; two lumbar abdominal straps, sewn into the waist-band seam of the back fabric panel, with the same type of buckle connections to the sides of the front fabric panel, connecting to the front fabric panel, below the waist line, at an angle, to help support and lift the abdomen; and two adjustable front straps, for connecting the pelvic support to the upper body support. The gusset area between the user's legs also has a removable foam rubber pad for comfort. The construction of this pelvic support allows for full range of motion at the user's hips and is intended for partial to full weight bearing exercises, as determined by the amount of lift desired, obtained, and maintained, by the shock cord and pulley block assembly mentioned above.

In this invention, the three different lower body supports, connect at the rear, to the upper body support by a horizontal opening zipper and a horizontal VELCRO hook tape strip, of equal length to the zipper, as well as, the front strap/straps, with male FASTEX side-release buckle connections mated to female FASTEX side-release buckle components attached to the front of the upper body support. The snaps used by Scales, to connect the upper body and crotch section, for infants up to forty pounds, do not provide longitudinal adjustability, are not safe when working with adults, and are very difficult and too time-consuming, to open and shut, when used in the numbers which are required for children over forty pounds.

Other examples of Prior Art, of which the applicant is aware includes the following:

3,778,052 Andow et al, December 11, 1973; 2,792,052, H. A. I. Johannesen, May 14, 1957, 2,657,688 I. Tucker, November 3, 1953; 4,497,069 Braunhut, February 15, 198; 3,641,997 Posey, Jr. February 15, 1972; 1,369,139, L. B. Sperry, February 22, 1921; 3,721,736 Barthel, Jr. March 20, 1973; 3,252,704, C. L. Wilson, May 22, 1963; 4,655,447 Dubrinsky, et al, April 7, 1987; 3,721,437 Skaricic, March 20, 1973; 4,488,691 Lorch, December 18, 1984; 2,775,288, A. Anastasia, December 25, 1956; 2,987,279 J. H. Gray, June 18, 1956.

SUMMARY

This invention relates to an overhead suspended, interchangeable support and harness exerciser system, which provides support to the user's body, in specific contact areas, with three different upper and lower body support combinations. Each of the combinations have specific clinical applications, when they are attached, by webbing straps, to an overhead horizontal trapezoid frame, suspended from a fixed point or from a rolling traveler on an overhead track, by a resilient fiddle block pulley assembly.

The upper body support may be combined with any one of the three alternative, interchangeable, lower body supports: a bucket seat, a crotch piece or a pelvic support. Attachment of one section to the other being obtained with side release buckles, such as FASTEX, horizontal opening zippers and VELCRO, hook and loop tape fastners, or similar products, for added strength, permitting combinations of an upper body support/bucket seat, upper body support/crotch piece or upper body support/pelvic support exerciser system.

The upper body support extends up from the waist to below the user's chin in the front and from the waist to above the user's head at the back, tapering to below the underarm level at the sides and is of one piece wrap-around fabric construction, with opening and closure under the user's right arm. The upper body support provides a choice of three bi-lateral waist girth sizes, accomplished by vertically placed zippers and VELCRO, hook and loop tape which also serve as the method of opening and closing. Four attached adjustable suspension straps connect the upper body support to the horizontal trapezoid frame. The Upper body support also has two front chest straps, each securing the female component of a FASTEX side-release buckle, which hang downwardly just above the user's waist level and mate up with the male FASTEX side-release buckle connection on the center front strap/-straps of each lower body support.

The bucket seat will maintain the user's hips in a flexed position at approximately 90 degrees, but the angle may be adjusted by varying the lengths of the four rear straps attached to the outside surface, of the wrap-around fabric section at the back of the bucket seat with the use of a LADDERLOC slide fastener on each strap and by altering the length of the front strap coming from under the seat portion of the bucket seat, by moving the male FASTEX side-release buckle connections at each end of the center front strap. The depth of the bucket seat can be reduced by shortening all five straps. Seat angle adjustments, side to side, can also be made to compensate for deformity, by adjusting strap lengths.

The crotch section is shaped to cradle the user's buttocks and support under the user's legs, for approximately one quarter of the length of the femurs. The crotch section will allow movement of the hip joints in the approximate range of 30 degrees to 90 degrees of flexion, during exercise, while maintaining approximately 45 degrees of flexion when the user is resting between exercise periods, providing that the user has been suspended at the correct distance from the floor. The approximate 30 degrees of hip flexion is very important, when the user is bouncing, because hip flexion prevents the user's feet from contacting the floor with stiff outstretched legs. There have been clinical studies reporting injuries to many parts of the body when users bounce in exercisers that do not maintain a slight amount of flexion at the user's hips.

The pelvic support when connected to the upper body support, will provide a supported pelvic tilt, with full range of motion at the user's hip joints. The two leg straps, attached to the pelvic support are angled slightly to secure the fabric under the buttocks. The pelvic support has two lumbar abdominal straps angled downward, sewn into the waist band seam at either side of the lumbar spine with male FASTEX side-release buckle connections that mate up with the female FASTEX side-release buckle components on the front fabric panel of the pelvic support. The two lumbar abdominal straps are designed to pull the front fabric panel taut at an angle under the abdominal bulge. Two internal abdominal flaps, with an adjustable internal abdominal strap, also provide abdominal support and encourage a healthy pelvic tilt to improve, or maintain, correct posture. Two front straps, at the top of the front fabric panel, allow for adjustability in depth for the pelvic support, as well as for connection to the upper body support.

A horizontal male zipper component on the inside surface of the back waist-band of each lower body support intermeshes with a horizontal female zipper component, at the waistline level, on the outside surface of the high back section of the upper body support, in such a way as to prevent body contact with engaged zippers. Matching horizontal VELCRO hook and loop tapes, equal in length to the horizontal zipper components, are employed for added strength.

The horizontal trapezoid frame, is of steel rod construction having a shorter front member, parallel to a longer back member, two angled side members of equal length, two parallel center square rod members, which span from front to back and a movable balance point consisting of an eye bolt, connector nut and a carriage bolt assembly which can be moved, positioned and secured between the parallel center square rod members. The horizontal trapezoid frame has six designated suspension strap placements, two front suspension strap placements at the outside corners of the front member, two back suspension strap placements at the outside corners of the back member and two adjacent, alternative, back suspension strap placements, on the side members. By changing the position of the movable balance point, adjusting the upper body support, front and back suspension strap lengths, and changing the placement of the two back suspension straps on the horizontal trapezoid frame; a treatment provider can create a semi-reclined position, (usually used in an upper body support/bucket seat exerciser combination) for persons who are unable to tolerate vertical postures, but who may benefit from movement and directional changes generated by their treatment providers.

A resilient cleated pulley assembly, employs a lower fiddle block pulley connected to the movable balance point on the horizontal trapezoid frame, by a universal head connection and an upper fiddle block, with built in camcleat, connected by a snap shackle to a fixed overhead suspension point or to a rolling traveler on an overhead track. The top fiddle block camcleat enables one person to adjust the user's position of height from the floor, easily and safely, for users of different size and weight. Shock cord of varying strengths is used to thread the fiddle blocks and thus provide an adjustable amount of; lift, rise and fall, bounce, lateral movement, anterior/posterior movement and shock absorbency, comfortably for the user and easily for the treatment provider.

DESCRIPTION OF THE PREFERRED EMBODIMENTS

Figure 1:
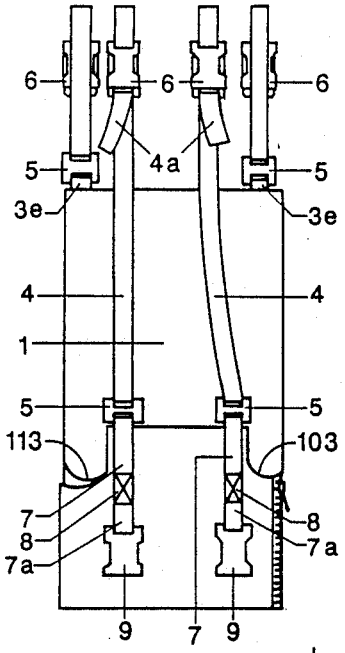
FIG. 1: front view of the upper body support, in closed position, adjusted to the smallest available waist size.

FIG. 1 is a front view illustration of the upper body support, closed at the smallest waist size available. The wrap-around fabric extends from waist level to above the user's head at the back 1, tapers to underarm level at the sides 103/113, and extends from waist level to below the user's chin, at the front 2. The fabric used is a heavy weight 65% polyester/35% cotton drill, a type of fabric often used to make rugby pants. The outside layer of fabric is cut on the warp straight-of-the goods and the inside, or lining areas, are cut on the weft straight-of-the goods. This cutting and sewing method maximizes the strength of the fabric. Curved edges are further reinforced with tape sewn into the seams but not visible on the finished parts. The back suspension straps 3 are attached to the upper body support by short folded pieces of webbing **3*e*, sewn into the top seam and passing through the lower slot in the TRIGLIDE buckle three bar glides 5. ELIZABETH MILLS polypropylene webbings are used throughout with ½" webbing having a safe load capacity of 250 pounds, 1" webbing having 500 pounds capacity and 2" webbing having 800 pounds capacity. The front suspension straps 4 have free ends 4*a* which allow for adjustability. A straight downward pull on the free ends 4*a* will shorten front suspension straps 4. Pushing the free ends 4*a* upward will lengthen the front suspension straps 4. The four TRIGLIDE buckles 5 attached to the upper body support allow the travel of suspension straps 3 and 4 for length adjustment. The FASTEX side-release buckles 6 allow for opening and closing the front suspension straps 4 to connect/disconnect from the horizontal trapezoid frame. The chest straps 7 are sewn into the top seam of the front 2, then threaded through the lower slots of the TRIGLIDE buckles 5. The chest straps 7 are secured on all sides by stitching them to the front 2 as far down as the extra reinforced stitching 8. The front suspension straps 4 are threaded through the top slots of the TRIGLIDE buckles 5 attached by the chest strap 7. The short folded sections 7*a* of chest straps 7, allow for ease in handling the female FASTEX side-release buckle components 9, and are doubled back and secured, under the extra reinforced stitching 8**.

Figure 2:
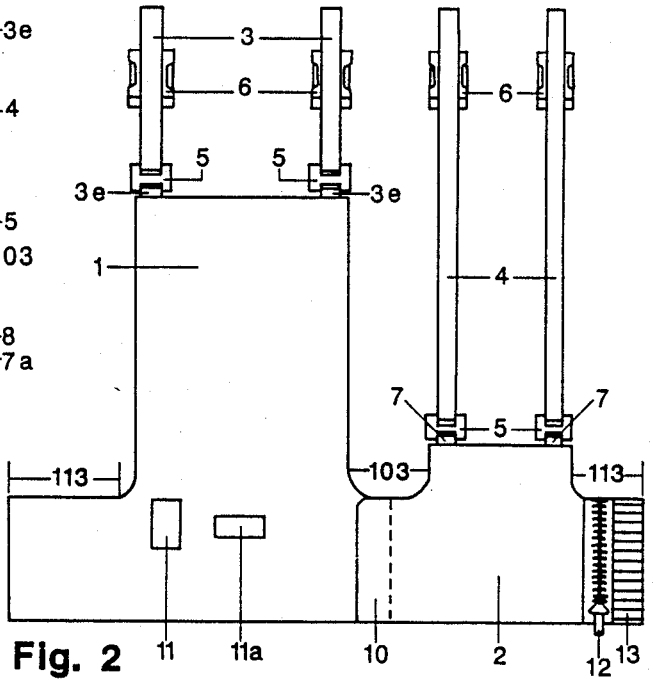
FIG. 2: inside view of the upper body support, opened out flat, with the left underarm section adjusted to smallest waist size available.

FIG. 2 is an inside view of the upper body support adjusted to size small, opened out flat and showing the vertical internal pleat 10 created by the left vertical underarm waist size adjustment zippers 16 and 14 closed on the outside surface of left underarm section 103. A fabric content and care label 11 is sewn in place on the inside surface of the back 1, as well as, a part name label **11*a*. The vertical female component 12 of the right underarm zipper closure is parallel to the VELCRO hook tape 13** which is used for added security. The VELCRO hook and loop tape closures used for children's models have a holding power of 8 pounds per square inch when used vertically and 16 pounds per square inch when used horizontally around curves. The VELCRO hook and loop tape closures used on adult models have one and a half or double the strength of the above. The ACME zippers used have a pull apart rating of 180 pounds per square inch, so that the combined holding power of the ten inch minimum length back-waist VELCRO tape and horizontal zipper component of a child's exerciser have a holding power of 240 pounds. The adult exerciser back waist zipper and VELCRO tape components are 14 inches or longer, therefore, they have a holding power of 628 pounds or more.

Figure 3:
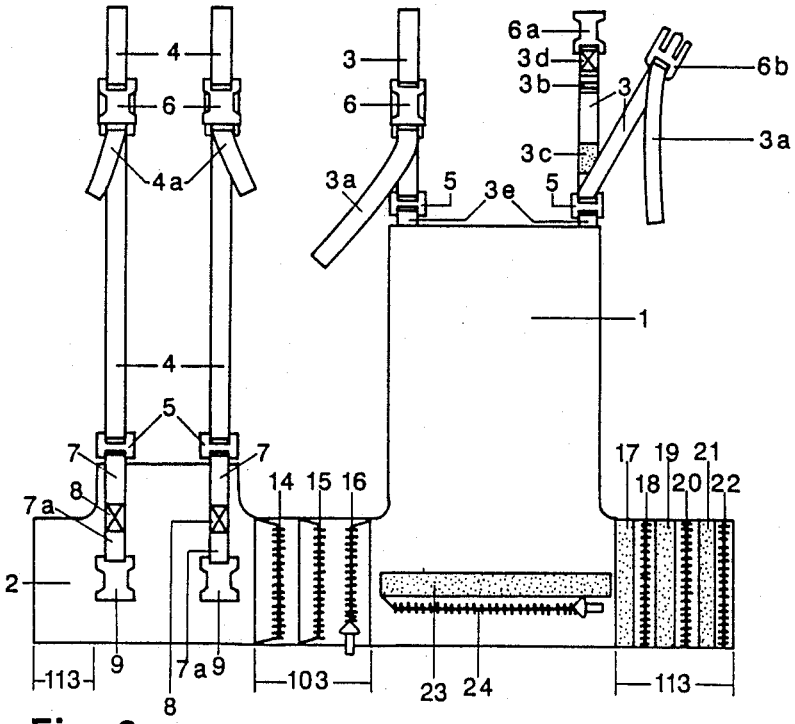
FIG. 3: outside view of the upper body support, opened to the largest available waist size. Right rear suspension strap open.

FIG. 3 is an outside view of the upper body support opened out to the largest available waist size which means that the female zipper component 16, mated to the male left underarm waist 103 size adjustment zippers 14, or 15, is disengaged from either zipper, allowing the release of internal pleat 10 illustrated in FIG. 2. In order to maintain the largest underarm distance bi-laterally, the vertical female zipper component 12, illustrated in FIG. 2, would be mated with the vertical male zipper connection 22, in FIG. 3, and VELCRO hook 13 and loop tapes 21, would be closed for added security. To make adjustment to size medium, on the left underarm section 103, vertical male zipper 15 and vertical female zipper 16 are joined, while vertical female zipper 12 and vertical VELCRO hook tape 13 are mated to vertical male zipper 20 and vertical VELCRO loop tape 19 at the right underarm section 113. To adjust to size small, vertical female zipper 16 and vertical male zipper 14 are mated at the left underarm side section 103, while closure on the right underarm section 113 is gained by mating vertical male zipper 18 and vertical VELCRO loop tape 17 to vertical female zipper 12 and vertical VELCRO hook tape 13 illustrated in FIG. 2. Horizontal VELCRO loop tape 23 and a parallel horizontal female zipper component 24 span the width of the back waist section of the back section 1 of the upper body support as a means of connection to the three alternative lower body supports the bucket seat, the crotch piece or the pelvic support. Small pieces of VELCRO hook tape **3*b* and VELCRO loop tape 3*c* secure the top end of the back suspension straps 3 around the horizontal trapezoid frame and maintain the female components 6*a* of the suspension strap FASTEX side-release buckles 6 just below the horizontal trapezoid frame. Similar VELCRO tape components serve the same purpose on the front suspension straps 4 but can only be seen when the suspension straps are opened. The reinforced stitching 3*d* secures strap 3 to the female FASTEX side-release buckle component 6*a***. All suspension straps are constructed in a similar way.

Figure 4:
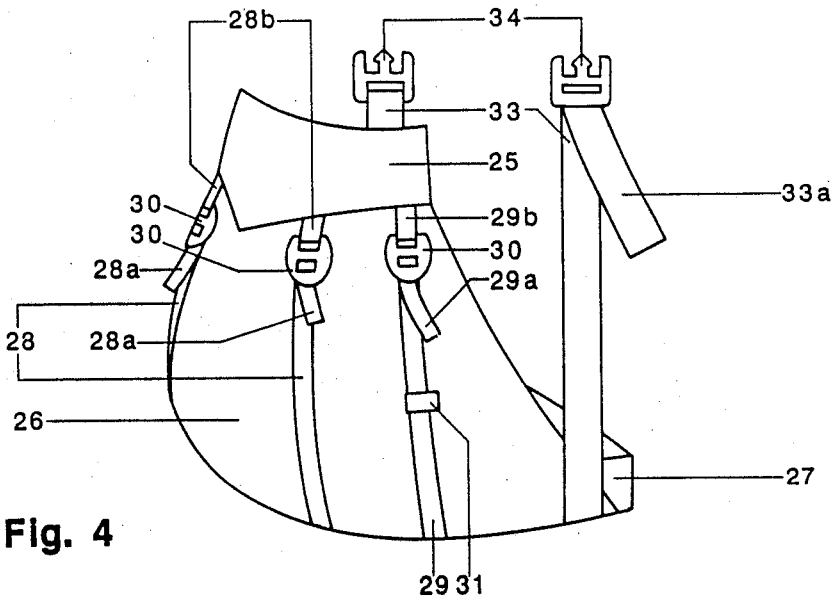
FIG. 4: rear oblique view of the bucket seat, showing the back shaping and adjustment straps.

FIG. 4 is a rear oblique view, approaching the right side of the bucket seat showing the back waist band 25 attached to the back section 26, which surrounds the curved edge of the seat 27 and extends nearly to the front of seat 27, on both sides. Darts in the fabric 32 create the required shape for back section 26. The LADDERLOC slide fastners 30 are attached by short folded pieces of webbing **28*b* and 29*b* sewn into the back waist band 25 seam. Four adjustment straps 29, 28, 28, and 29 allow for seat 27 angle and depth adjustment. The two side adjustment straps 29 are secured in position by belt loops 31 (only one of which can be seen in this view). The free ends 28*a* and 29*a* are employed to make angle and depth adjustments. The front strap 33 is secured on the underside of seat 27 and is adjustable in length by pulling straight down on the free end 33*a* where they protrude from the male FASTEX side-release buckle connections 34 which are mated to the front female FASTEX side-release buckle components 9** on the upper body support. The FASTEX, TRIGLIDE and LADDERLOC components used are all within the safe load limits suggested by the manufacturer, ITW NEXUS. Note: steel rectangles are used to replace the TRIGLIDES on OVERSIZED adult exercise assists.

Figure 5:
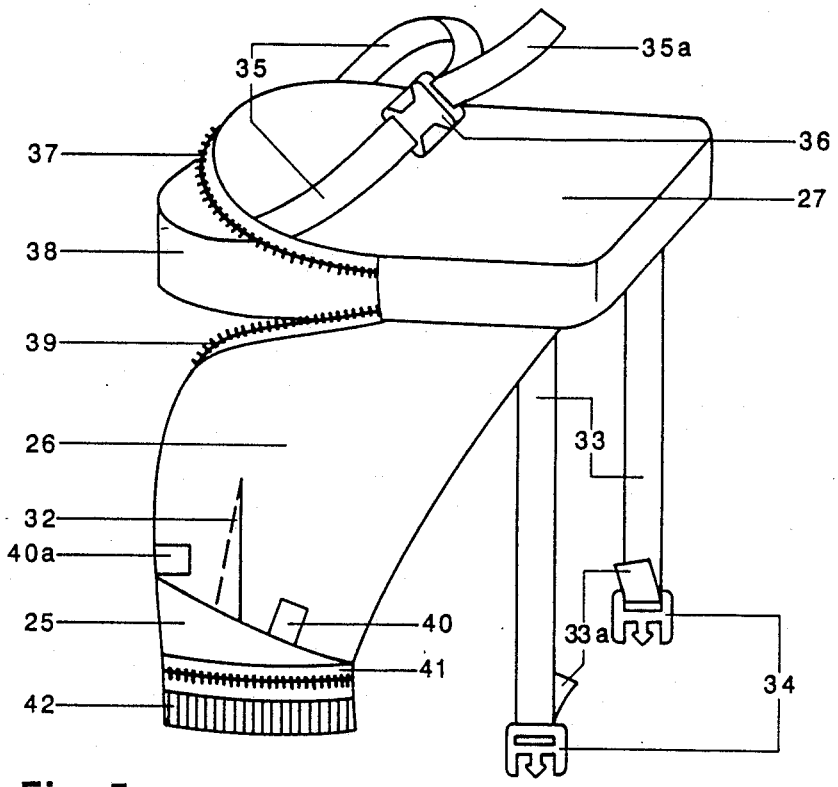
FIG. 5: side view of the bucket seat, with padded board partly removed, and showing the seat belt.

FIG. 5 is a side view of the bucket seat, with the padded board 38 partly removed from the seat 27 by pulling back section 26 down as far as possible and opening the concealed internal zipper 37/39. The padded board 38 has high density foam padding glued to the upper surface, thin AIROLITE foam underneath and AIROLITE foam completely surrounding the edges and covering the depth of the board and both layers of foam padding. The front outside corners of the padded board 38 are rounded for comfort and safety. A fabric content and care label 40 is secured in the waist band 25 seam. A part name label **40*a* is sewn on to the fabric. The horizontal male zipper component 41 and horizontal VELCRO hook tape 42 mate to horizontal female zipper 24 and the horizontal VELCRO loop tape 23** of the upper body support, illustrated in FIG. 3.

Figure 6:
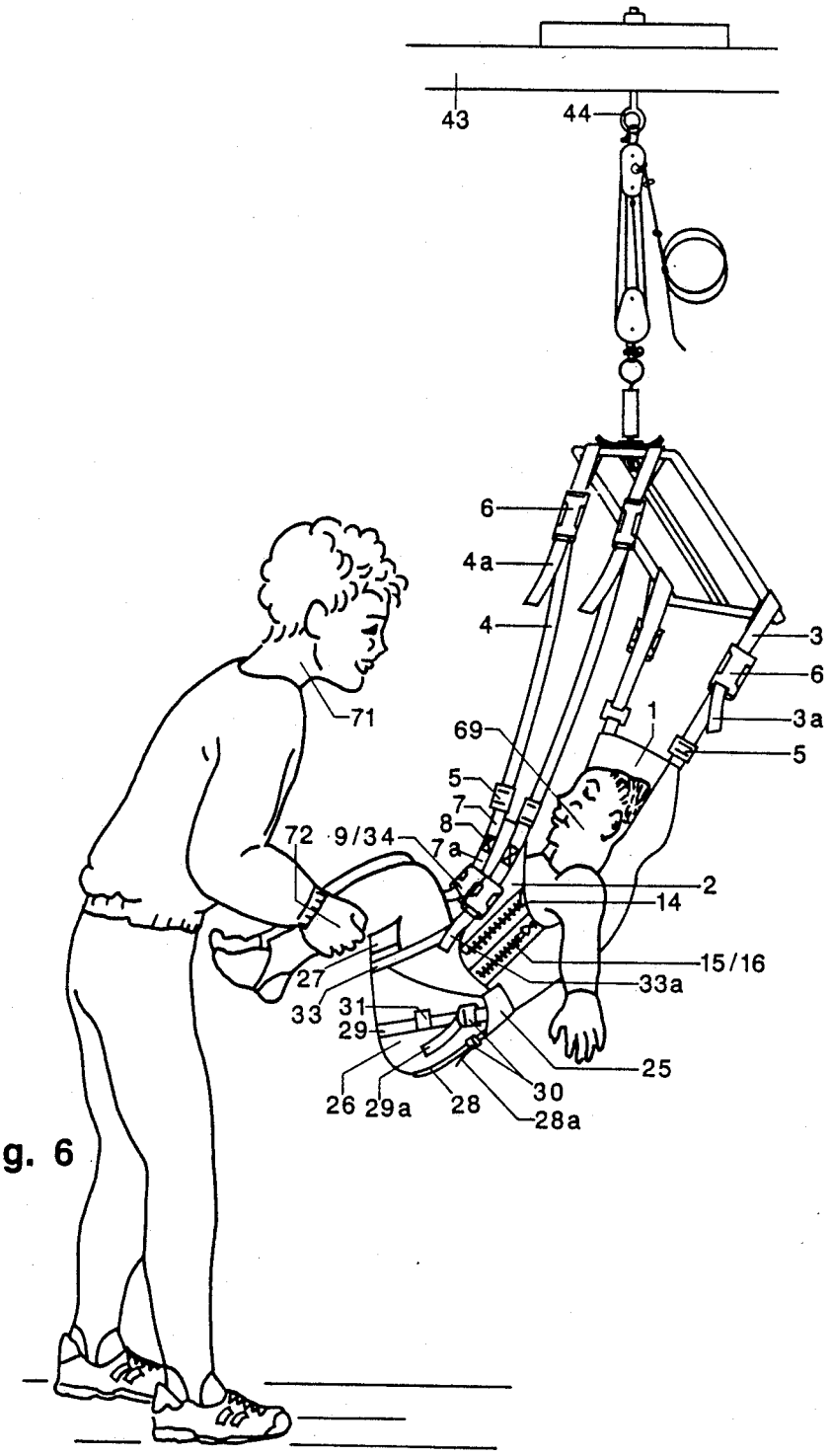
FIG. 6: side view of the upper body support and the bucket seat, connected to the horizontal trapezoid frame, with a forward placement of balance point, attached by the resilient shock cord and fiddle block pulley assembly, to a fixed overhead point, with a treatment provider and an exerciser system user.
Figure 16:
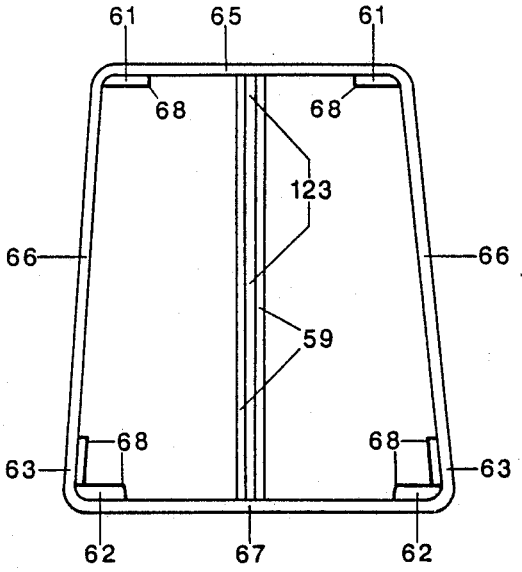
FIG. 16: overhead view of the steel round rod, horizontal trapezoid frame E, showing the six suspension strap placements, the two parallel center square rod members and the position range of the movable balance point F.
Figure 18:
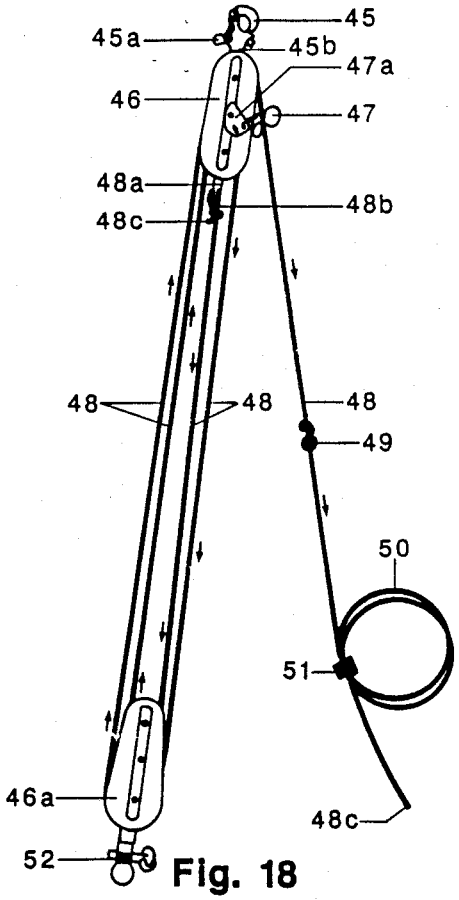
FIG. 18: detailed side view of fiddle block pulley assembly G.
Figure 17:
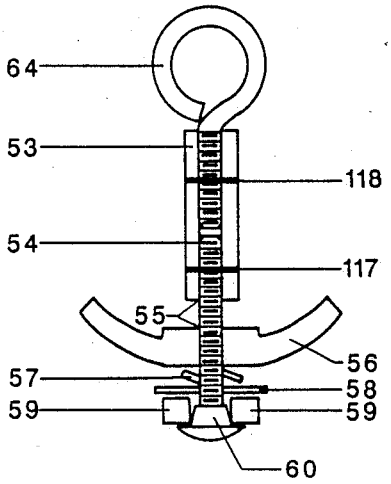
FIG. 17: close-up, cross-sectional view, of the movable balance point connection F.

FIG. 6 is a side view of an upper body support-/bucket seat combination exerciser, suspended from an eye bolt 44 secured in reinforced beam 43 by the fiddle block pulley assembly, illustrated in FIG. 18, attached to the movable balance point, illustrated in FIG. 17, positioned toward the front of the horizontal trapezoid frame, illustrated in FIG. 16. In addition to moving the balance point connection the treatment provider 71 has lengthened the rear suspension straps 3 and moved them to the alternative back suspension strap placements 63 on the horizontal trapezoid frame. Adjustments have been made to the bucket seat also. The rear adjustment straps 28 have been let out as far as possible, while the side adjustment straps 29 have been shortened. The front strap 33 has been shortened, at each end, as far as possible. All of these changes combine to create a semi-reclined posture for the user 69 especially when held and supported under the legs 70, by the treatment provider's hands 72. The upper body support, Model 456, has been closed at size medium. A therapeutic exerciser upper body support/bucket seat combination may also be assembled to allow the user 69 to sit up straight, by reversing the changes explained above. There are two recommended methods as to how to place a user in an upper body support/bucket seat exerciser. In most cases, the easiest method is to assemble and suspend the exerciser. Then adjust the pulleys until the bottom of the seat 27 just barely contacts the seat of a straight-backed chair. A treatment provider would then; select the correct left underarm 103 section size range, open up the zipper on the right underarm section 113, disconnect the center front FASTEX side-release buckles 9/34 and open the seat belt buckle 36. If the user is allowed to sit up straight, the user is most often transferred from a wheel chair to the seat 27, the seat belt 35 is closed and adjusted in length as required, the right underarm section 113 is closed to correspond to the size selected on the left underarm section 103, the front FASTEX side-release buckles 9/34 are closed and the length, at each end, of the front strap 33 is checked. The fiddle block pulley assembly, is then used to lift the user away from the chair, the chair is taken away and the exerciser is raised or lowered at the discretion of the treatment provider. In some cases, where the user cannot sit up straight, two treatment providers are required. The first treatment provider sits on a chair or a hassock, holds the bucket seat on their lap and grasps the user when the second treatment provider transfers the user to the seat portion 27. The bucket seat is then closed and adjusted as described earlier.

Figure 7:
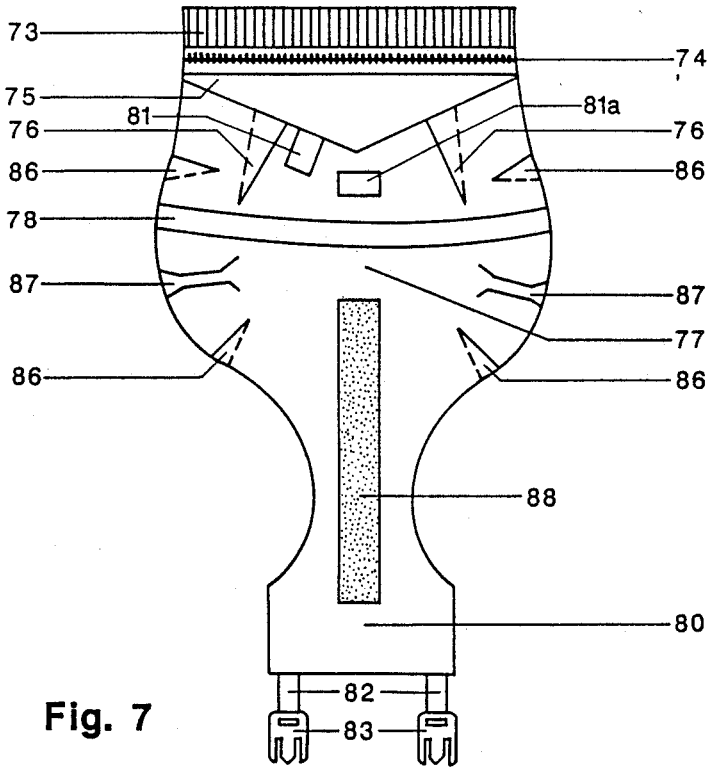
FIG. 7: inside view of the crotch section adjusted to minimum length.

FIG. 7 is an inside view of the crotch section adjusted to the shortest length available. Horizontal VELCRO hook tape 73 and horizontal male zipper 74 allow for attachment to horizontal VELCRO loop tape 23 and horizontal female zipper 24 at the waist level of the back section 1 on the upper body support. The back waist band 75 and darts 76 in the crotch back fabric section 77, allow for the shaping needed for user's buttocks. A horizontal pleat 78 is visible in this view when the crotch back section 77 is adjusted to short. A pair of darts 86 and a large pleat 87 on both sides of the crotch piece, help to create a pouch effect in the fabric to cradle and support the user's buttocks. The length of the front 80 is controlled by the length of the center front straps 82, which in turn is obtained by the position of the male FASTEX side-release buckle connections 83. The fabric content and care label 81 and part name label 81*a* are sewn on to the fabric. A VELCRO loop tape 88 which mates up with VELCRO hook tape 89*a* on the ENSOLITE foam rubber pad shown in FIG. 19.

Figure 8:
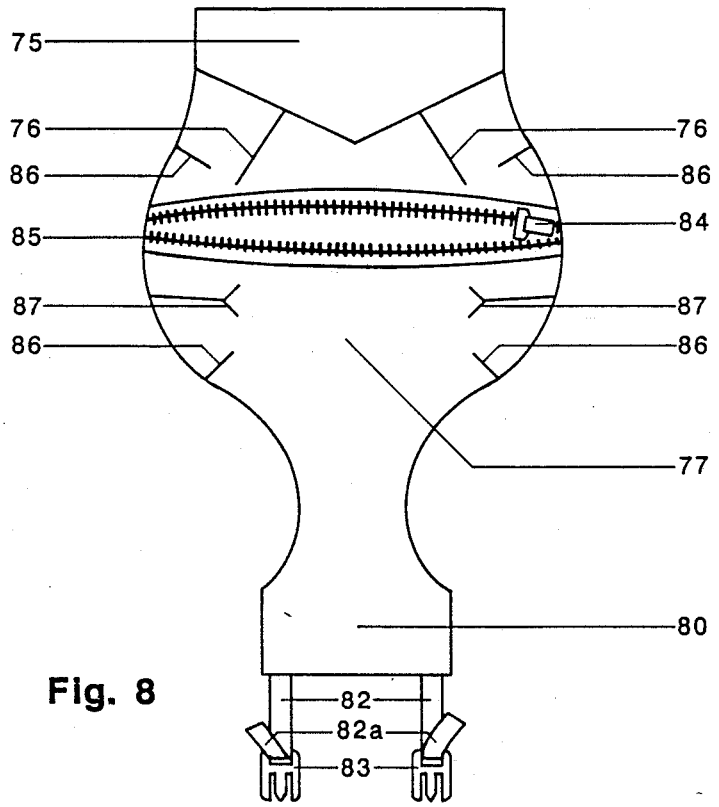
FIG. 8: outside view of the crotch section adjusted to maximum length.

FIG. 8 shows the crotch piece extended to "long" by opening horizontal female zipper 84 and horizontal male zipper 85 and by lengthening the center front straps 82 as far as needed. A VELCRO loop tape 88 allows for the attachment of the ENSOLITE foam pad shown in FIG. 19.

Figure 9:
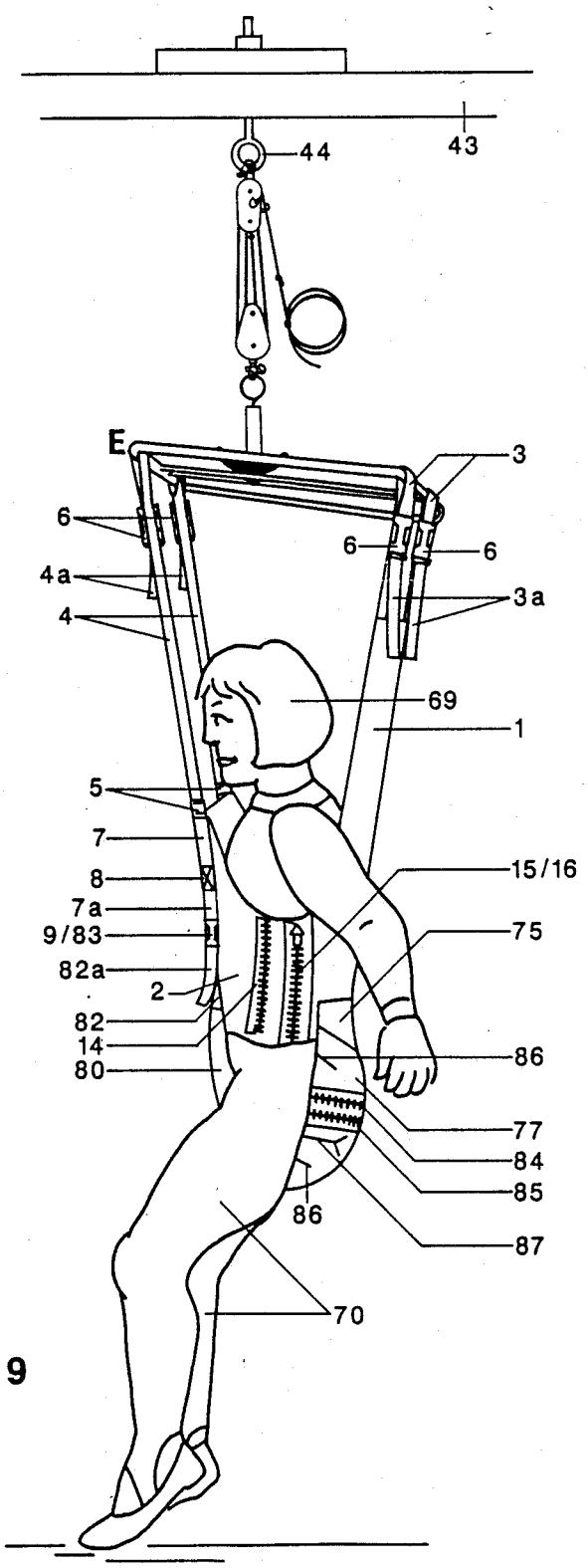
FIG. 9: side view of the upper body support and the crotch section connected, and showing a user in proper body position for bouncing exercises.

FIG. 9 shows the user 69 in the proper position to start bouncing, legs 70 in forty-five degrees relaxed position, and the upper body support, Model 789, closed at size medium. The crotch piece is at full length at the back, with the horizontal female zipper 84 and horizontal male zipper 85 open. The center front straps 82 are at approximately mid-length. It is recommended that the fiddle block pulley assembly be secured to a fixed overhead point, preferably in a reinforced beam 43 when using an upper body support/crotch piece exerciser combination. The movable balance point is usually secured slightly forward of the center of the parallel center square rod members 59 of the horizontal trapezoid frame when used with an upper body support/crotch piece exerciser. The back suspension straps 3, most often are placed at the back suspension straps placements 62 for free exercise in the upper body support/-crotch piece exerciser, but the back suspension straps 3, could be attached at the alternative back suspension straps placement 63, if the user needed to be supported more by the back section 1 of the upper body support. The two methods of putting a user in an upper body support/bucket seat exerciser, described under FIG. 6, can also be applied to using an upper body support/-crotch piece exerciser but a third, most often used, method is; disconnect suspension straps 3 and 4 from the horizontal trapezoid frame; open the exerciser out flat, lining side up, on a floor mat, plinth or bed; position the user on the fabric, determine and make the correct waist size closures; connect the center front FASTEX side-release buckles 9/83 and adjust the length of the center front straps 82; position the user under the suspended horizontal trapezoid frame and re-connect the straps 3 and 4 to the horizontal trapezoid frame. At the end of the exercise period the user may be lowered on to a floor mat or seated into a wheel chair before opening the right underarm section 113 and disconnecting the FASTEX side-release buckles 9/83 to release the user from the exerciser.

Figure 10:
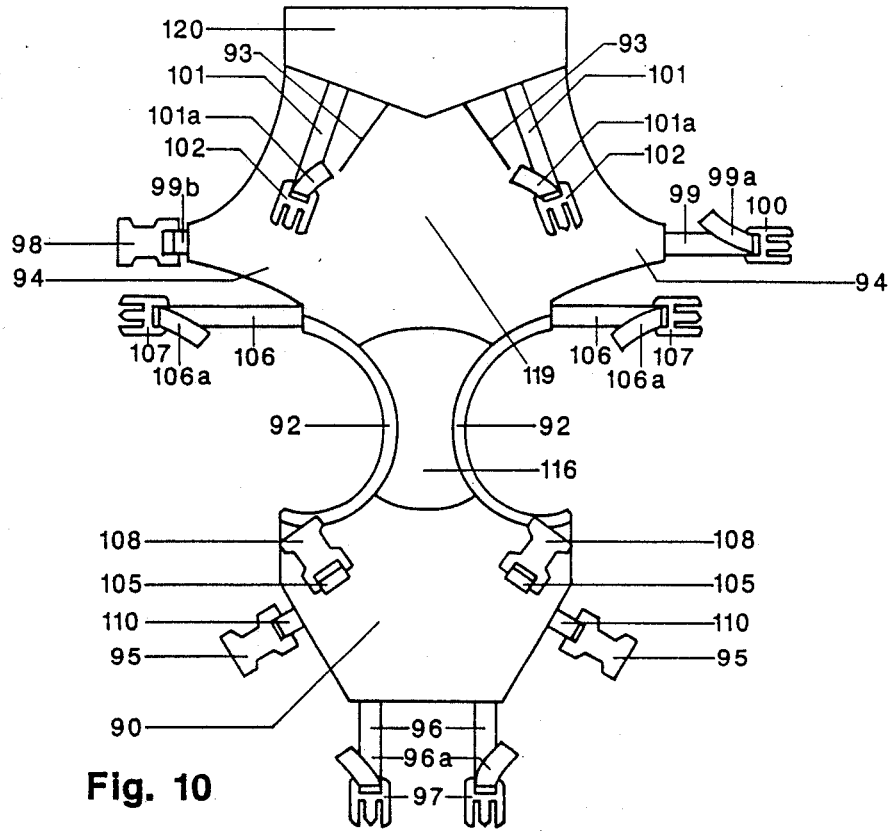
FIG. 10: outside view of the pelvic support spread out on a flat surface.

FIG. 10 is an outside view of the pelvic support spread out on a flat surface. The back waist band 120 is sewn onto the back section 119 with darts 93 to provide shape. Lumbar abdominal straps 101 have free ends 101*a* and male FASTEX side-release buckle connections 102. The internal abdominal strap 99, sewn onto the right abdominal flap 94, has a male FASTEX side-release buckle connection 100, which, when mated up with the female FASTEX side-release buckle component 98, attached to the left abdominal flap 94 by a short piece of folded webbing 99*b* brings the right and left abdominal flaps 94, around the body. The gusset 116 joins the back 119 and the front 90, and has a VELCRO loop tape 79 which mates up with VELCRO hook tape 89*a* on the ENSOLITE foam rubber pad shown in FIG. 19. Female FASTEX side-release buckle components 108 are attached to the front 90 and connect with male FASTEX side-release buckle connections 107 on the leg straps 106. The short pieces of folded webbing 105 and 110 secure the female FASTEX side-release buckle components 108 and 95 to the front 90. The female FASTEX side-release buckle components 95 are mated to the male FASTEX side-release connections 102 on the lumbar abdominal straps 101. Male FASTEX side-release buckle connections 97 on center front straps 96 connect with female FASTEX side-release buckle components 9 on the chest strap 7*a* of upper body support A. Heavy elastic 92 binds the outside edges of the gusset 116 and the outside edges of the adjoining back 119 and front 90 as far as the leg strap 106 attachments at the back and the side edge of the front 90.

Figure 11:
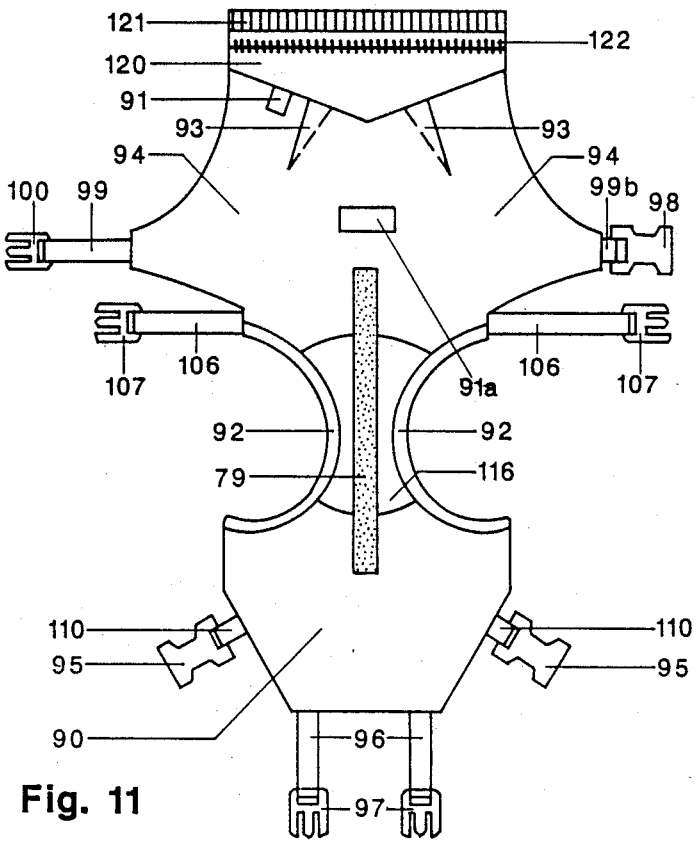
FIG. 11: inside view of the pelvic support opened out flat.

FIG. 11 is an inside view of the pelvic support revealing a VELCRO loop tape 79 to provide attachment of an ENSOLITE foam rubber pad. The fabric content and care label 91 is sewn into the back waist band 120 seam. A part name label 91*a* is sewn on to the fabric. Darts 93 in the fabric allow for shape. The heavy elastic binding 92 sandwiches, the outside edges of, both layers of the fabric between the user's legs and forms the leg openings. The center front straps 96 have male FASTEX side-release buckle connections 97. Female FASTEX side-release buckle components 95 are secured to the front 90 by short folded webbing pieces 110. A female FASTEX side-release buckle component 98 is attached to the left abdominal flap 94 by a short piece of folded webbing 99*b*. The internal abdominal strap 99 is sewn to the right abdominal flap 94, with the male FASTEX side-release buckle connection 100 and the free end 99*a* of the internal abdominal strap 99 showing at the left side of FIG. 10. The front perimeter 112 of the ENSOLITE foam rubber pad protects above the user's pubic bone but below the user's navel. The rear perimeter 111 of the ENSOLITE foam rubber pad comes nearly to the cleavage of the user's buttocks and helps to prevent the fabric from bunching or binding, between the user's legs. Horizontal VELCRO hook tape 121 mate up with horizontal VELCRO loop tape 23 on and horizontal male zipper 122 mates up with horizontal female zipper 24 of the upper body support A. Leg straps 106 with male FASTEX side-release buckle connections 107 are sewn to the back section 119 of the pelvic support.

Figure 12:
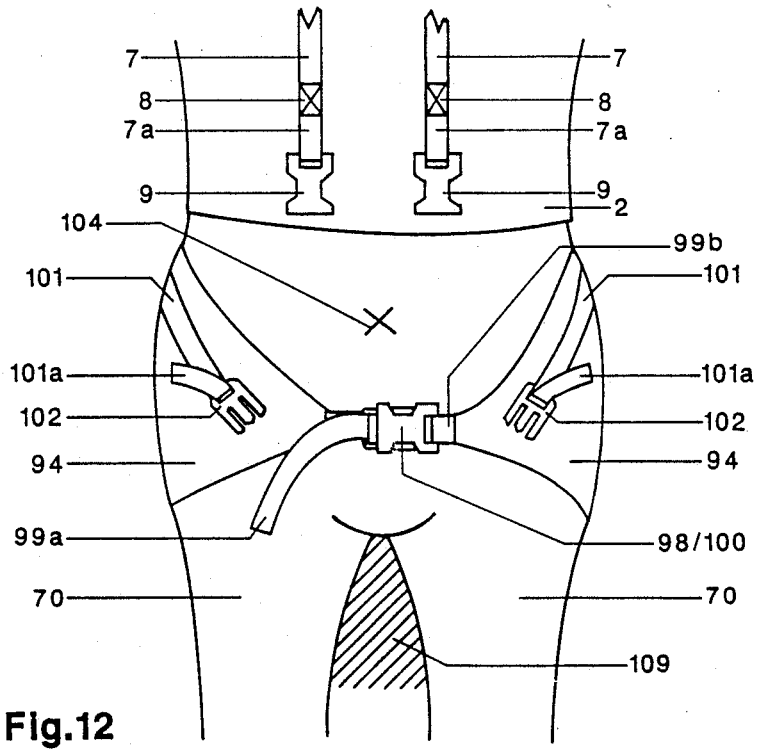
FIG. 12: overhead view of D, connected to A at the back, and a user laying on his/her back, with the internal abdominal strap ONLY, closed at the front, under the user's abdominal bulge.

In FIG. 12 an overhead view, with the user laying on his/her back, the waist band of the pelvic support has been connected to the back section of the upper body support. The remaining parts of the pelvic support are represented by the shaded area 109 (under the body and out of view) and only the FASTEX side-release buckle 98/100 of the internal abdominal strap 99 has been closed. The lumbar abdominal straps 101 have been lengthened by sliding the male FASTEX side release buckle connections 102 towards the free ends 101*a* to make it easy to connect them with the female FASTEX side-release buckle components, which can not be seen in this view, and then pull the free ends 101*a* to adjust the length of the lumbar abdominal straps 101. The approximate area of the user's navel is designated by number 104.

Figure 13:
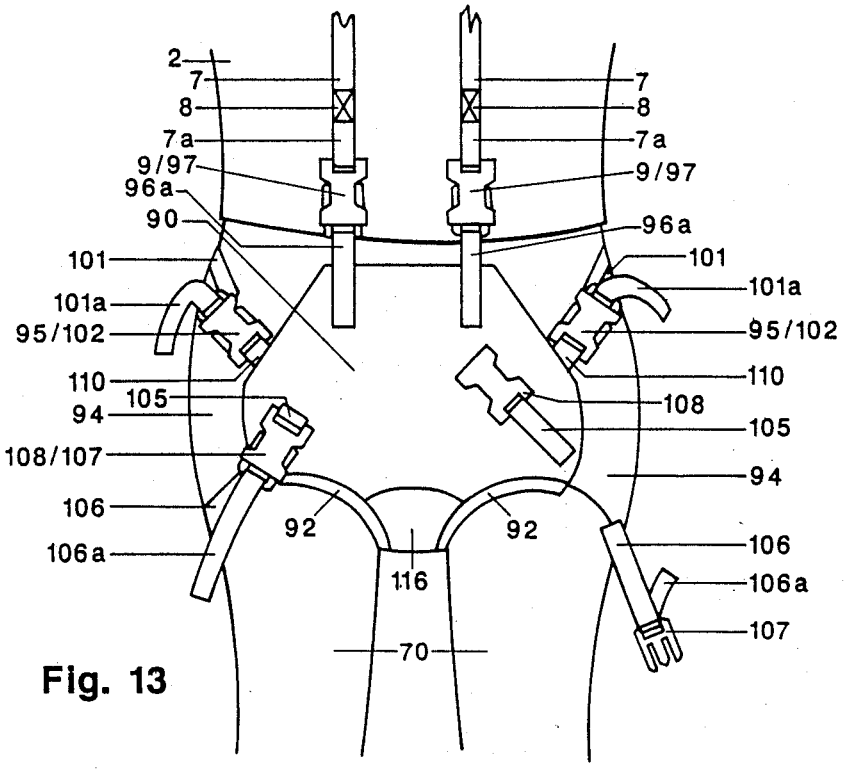
FIG. 13: overhead, as above, view of D connected to A, with five out of six FASTEX buckles closed, (user's left leg buckle open).

In FIG. 13, an overhead view, as above, of an upper body support/pelvic support combination exerciser shows all of the FASTEX side-release buckles closed with the exception of the left female FASTEX side-release buckle component 108 and the left male FASTEX side-release buckle connection 107, at the user's left leg 70. The female FASTEX side-release buckle components 108 are attached to the front 90 of the pelvic support, by short folded webbing pieces 105 which are sewn at approximately a 45 degree angle and are hidden under the female FASTEX side-release buckle components 108 when the female FASTEX side-release buckle components 108 and male FASTEX side-release buckle connections 107 are closed. The leg strap 106 and FASTEX side-release buckles 107/108 arrangement draws the back of the pelvic support under the user's buttocks. The heavy elastic binding 92 also helps to draw the fabric under the user's buttocks. The webbing pieces 105 allow the female FASTEX side-release buckle components 108 to hinge away from the user's leg 70 and avoid a possible pinching of the user's skin when closing FASTEX side-release buckles 107/108.

Figure 14:
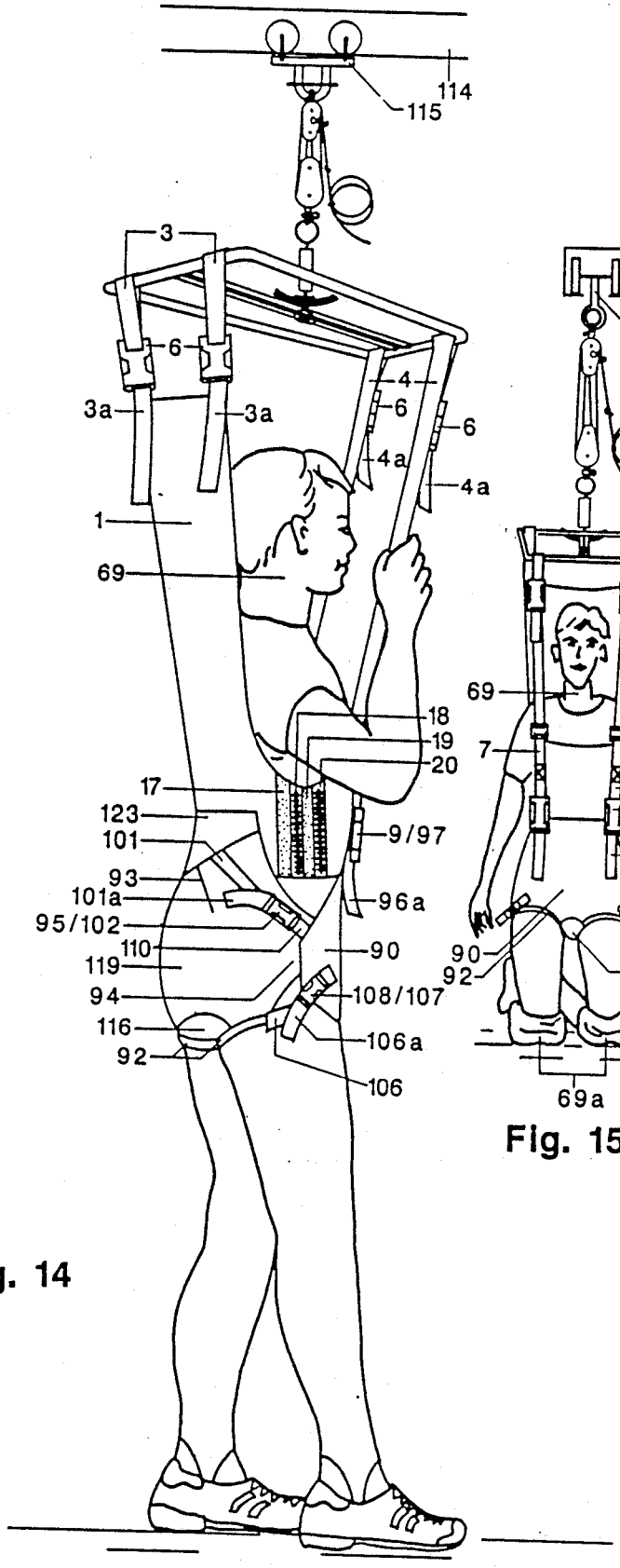
FIG. 14: side view of D connected to A, with a user in a gait training program suspended from an overhead sailing track.

In FIG. 14, an upper body support/pelvic support combination exerciser is being used in a gait-training program, connected by the fiddle block pulley assembly, to the movable balance point F, secured near the center of the parallel center square rod members 59 of the horizontal trapezoid frame and suspended from a sailing track 114 with a rolling traveler 115. The heavy set user 69, in the foreground, needs the upper body support, Model RA, at waist size large. Zippers 12 and 22 are mated and VELCRO hook tape 13 and loop tape 21 are closed at the right underarm section 113. Zipper components 14, 15 and 16 are all open at the left underarm section 103 but none of these elements can be seen in FIG. 14. The third method of placing a user in an exerciser, described under FIG. 9, is the only method recommended for an upper body support/pelvic support exerciser. It is especially advantageous to be able to position the internal abdominal flaps 94, and to adjust the length of the internal abdominal strap 99, as tightly as comfortably tolerable, while the user 69, is laying on their back. The leg strap FASTEX side-release buckles 108/107 are fastened next and the free ends 106*a* are pulled up snug. Then the center front FASTEX side-release buckles 9/97 are connected and the center front straps 96 are adjusted, lastly the male FASTEX side-release buckle connections 102 on the lumbar abdominal straps 101 are mated to the female FASTEX side-release buckle components 95 and the lumbar abdominal straps 101 are adjusted to draw the front 90 taut. Care should be taken to be sure that the user is well centered, the gusset 116 is smooth, and the ENSOLITE foam rubber pad is in proper position before reconnecting the exerciser to the horizontal trapezoid frame and lifting the user to their feet, or knees, with the help of the fiddle block pulleys. When the gait-training period is over, it is best to, lay the user down, disconnect the exerciser from the horizontal trapezoid frame, and then remove the exerciser from the user's body.

Figure 15:
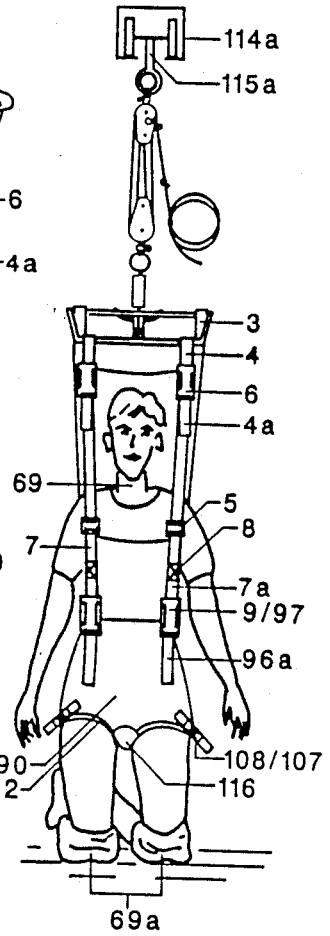
FIG. 15: front view of D connected to A, with a user knee walking suspended from an overhead barn door track.

FIG. 15 is a front view of a thin user 69 in a knee-walking program, with pads 69*a* to protect the knees. This person would most likely be using a Model JP exerciser, closed at size "small". A barn door track 114*a* with a single axle pair of rollers 115*a* is shown as an alternative to using the much costlier sailing track shown in FIG. 14.

FIG. 16 is an overhead or underside view of the horizontal trapezoid frame. The front suspension strap placements 61 are at the ends of front member 65. Back suspension strap placements 62 are at the ends of back member 67 of the frame. Alternative back suspension strap placements 63 are adjacent to placements 62 on the side members 66 of the horizontal trapezoid frame. The movable balance point may be secured within the range 123 between the parallel center square rod members 59 of the frame. Fine L shaped members 68 define the suspension strap placement and prevent the suspension straps 3 and 4 from moving on the horizontal trapezoid frame. The horizontal trapezoid frame is made of chrome plated steel rod, using round steel rod for members 65, 66, 67 and 66 and square rods for the parallel center members 59 and 59.

FIG. 17 is a near to actual size, drawing of the movable balance point, shown in cross-section. The coupler nut 53 contains an eye bolt 64, turned completely inside and spring pin 118 in place, at the top end of the coupler nut 53. The carriage bolt 54 (exaggerated in length in this drawing to show all components), with shoulders 60, passes upward; between the parallel center square rod members 59 of the horizontal trapezoid frame, through a fender washer 58, a lock washer 57, a custom made "wing nut" 56, and then leaves several bare threads 55 on the carriage bolt 54, before entering the coupler nut 53 and butting up against the bottom end of the eye bolt 64 inside the coupler nut 53. The bare threads 55 mean that the wing nut 56 may be turned upwards enough to loosen the pressure of the fender washer 58 against the parallel center square rod members 59 of the horizontal trapezoid frame, so that the movable balance point can be slid to the desired position within the normal range 123 on the parallel center square rod members 59, of the horizontal trapezoid frame, then the wing nut 56, may be turned down tightly, to secure the movable balance point. A spring pin 117 passes through the coupler nut 53 and the carriage bolt 54 to prevent carriage bolt 54 from turning out of coupler nut 53.

In FIG. 18 the top fiddle block 46 has a snap shackle 45 with three hundred and sixty degrees of rotation at their contact connection 45*b*. A pull pin 45*a* allows for quick contact to, or release from, an overhead eye bolt or rolling traveler. The top fiddle block pulley 46 has a camcleat 47 with an angle adjustment arm 47*a* to select the best angle of position for the camcleat 47. The bottom fiddle block pulley 46*a* has a universal head connection 52 which also rotates three hundred and sixty degrees and is used to prevent accidental dis-connection of the fiddle block pulley assembly from the horizontal trapezoid frame. The shock cord 48 is shown with small direction-of-travel indications beginning at the becket 48*a* attachment of the top fiddle block 46 and travelling beneath the small shieve of the bottom fiddle block 46*a*, over the small shieve of the top fiddle block 46, under the large shieve of the bottom fiddle block 46*a*, then over the large shieve of the top fiddle block 46, out and through the camcleat 47. It is suggested that an overhand safety knot 49 be tied in the shock cord 48 once that the home, school, or hospital, has determined the maximum length allowable to prevent the largest or heaviest user's head from contacting the floor should the camcleat 47 and shock cord 48 connection accidentally be improperly engaged, by a treatment provider, or disconnected by someone in the peer group. Any extra shock cord should be coiled up 50 and secured by the VELCRO hook and tape strap 51. Both ends of the shock cord **48*c* are taped to prevent fraying. At least four heavy duty hog wires 48*b* are crimped to secure the shock cord 48 to the becket 48*a***. Shock cord of various strength with a durable nylon covering, supplied by ROSS MATHEWS CORP., has been found the most satisfactory as they are capable of producing exactly to our requirements for; lift, stretch, re-coil, rise and fall and shock absorbency, within a peer group. The manufacturer's safe load limit is over 400 pounds. The safe load limits of the marine quality fiddle block pulleys used range from 1500–3500 pounds or more.

Figure 19:
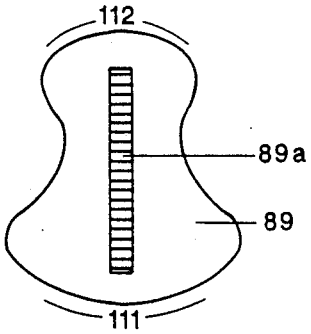
FIG. 19: underside view of the ENSOLITE foam rubber pad H.

FIG. 19 an underside 89 view of the ENSOLITE foam rubber pad. The front perimeter 112 is narrower than the back perimeter 111 and the VELCRO hook tape **89*a* mates up with the VELCRO loop tape 88 on the crotch piece, or the VELCRO loop tape 79** on the pelvic support.

I claim:

1. An adjustable overhead harness exerciser kit for attachment to an overhead beam comprising;

a user support harness comprising an upper body support, and a selected lower body support removably attached to the bottom of said upper body support, said upper body support being suspended with a plurality of straps from a trapezoid frame;

attachment means comprising a pulley and shock cord assembly for attaching said trapezoid frame to said overhead beam, said attachment means having positionally adjustable attachment with said trapezoid frame;

whereby changing the position of said attachment means to said trapezoid frame changes the pivot point of balance of said user support harness for adjustable tilt of the user when supported by said user support harness.

2. The adjustable overhead harness exerciser kit of claim 1 further comprising a rolling traveller between said overhead beam and said attachment means for rolling connection of said attachment means to said overhead beam.

3. The adjustable overhead harness exerciser kit of claim 1 wherein the said lower body support selected is from the set consisting of: a pelvic support, a bucket seat and a crotch section.

* * * * *